US006402627B1

(12) United States Patent
Gordon

(10) Patent No.: US 6,402,627 B1
(45) Date of Patent: Jun. 11, 2002

(54) INFLATABLE RECREATIONAL DEVICE

(75) Inventor: Donald W. Gordon, Draper, UT (US)

(73) Assignee: Aviva Sports, L.L.C., Montreal, MO (US)

( * ) Notice: Subject to any disclaimer, the term of this patent is extended or adjusted under 35 U.S.C. 154(b) by 0 days.

(21) Appl. No.: 09/483,821

(22) Filed: Jan. 15, 2000

(51) Int. Cl.[7] ..... A63G 11/00
(52) U.S. Cl. ..... 472/114; 472/14; 472/134
(58) Field of Search ..... 472/14, 25, 106, 472/108, 114, 134; 297/245, 247, 270.5

(56) References Cited

U.S. PATENT DOCUMENTS 2,804,123 A * 8/1957 Kling ..... 472/25
4,099,773 A * 7/1978 Chang ..... 297/270.05

OTHER PUBLICATIONS

Skill Development Equipment Catalog about 1972, p. 40.

* cited by examiner

*Primary Examiner*—Kien T. Nguyen
(74) *Attorney, Agent, or Firm*—Mallinckrodt & Mallinckrodt; Robert R. Mallinckrodt

(57) ABSTRACT

An inflatable rocking recreational device includes an inflatable main body having a generally arc-shaped bottom surface for resting in water or on a surface such as the ground or a floor, and on which the device can be rocked. The device can include a plurality of connected bodies such as a main body with stabilizing bodies secured thereto or two or more main bodies secured side-by-side or at angles to one another to stabilize the body. Handles are provided to allow the users to grip and hold on to the body. The device is usually mounted by a plurality of users who rock the device back and forth along the arced bottom surface.

21 Claims, 6 Drawing Sheets

INFLATABLE RECREATIONAL DEVICE

BACKGROUND OF THE INVENTION

1. Field

Figure 1:
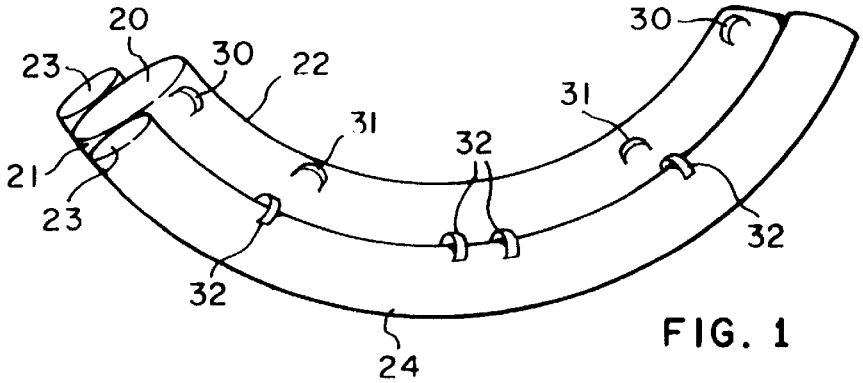

The invention is in the field of inflatable recreational devices for recreational play in water or on land.

2. State of the Art

There are numerous inflatable toys available for water play. These toys float in the water and may be climbed upon by users and may take the form of inner tubes, flat floating mattresses, various shaped animals, or inflatable boats. During water play with some of these floating toys, one or more users will try to mount the toy and it will roll or tip making it difficult to mount, a person mounted on the toy will cause it to roll or tip making it difficult for another person to mount the toy, or a person in the water will cause the toy to roll or tip trying to cause a person on the toy to fall off into the water. None of these toys, however, are designed specifically for rocking play by a user.

Various rocking toys for use on a firm surface such as a floor or the ground are available. A basic rocking toy is a teetertoter or seesaw wherein an elongate plank is pivotally mounted at its center to a support and users sit at opposite ends of the plank and go up and down as the plank pivots about the support. However, a user can dangerously fall to the ground if on the end of the plank that is up in the air if a user at the other end unexpected gets off.

Another basic rocking toy is a rocking horse where a horse or other shaped toy is secured to arc-shaped rocking rails. A user mounts the toy and rocks back and forth on the arc-shaped rails. These rocking toys are generally used by a single user who controls the rocking and there is no interactive play on such toys. Similar rocking toys which have an arced surface and are made of a hard plastic material are also available, see, for example, U.S. Pat. No. 3,730,522. A problem with such toys is that feet or fingers can get between the hard arced rails or surface of the toy and the hard surface the toy is rocking on and become injured. Such toys are similar to traditional rocking chairs.

Some inflatable toys in the shape of animals or fanciful characters have been available having a generally arced lower surface so users can mount the toys and rock thereon. Such toys, however, are sized and configured so that a user's feet can touch the ground, at least during some rocking of the toy, and such toys are not stable if feet do not touch the ground, i.e., the toys can roll over rather than remaining on their arced surface. This is particularly true in water where such toys have no stability. Further, such toys have not had handles or hand grips thereon, so a user merely squeezes a portion of the inflated toy to try to hold on during play.

SUMMARY OF THE INVENTION

According to the invention, an inflatable rocking recreational device includes an inflatable main body with a generally arc-shaped or arcuate bottom surface and is sized to be mounted by one or more users so it can be rocked back and forth by such users. Hand grips are provided in locations where they are accessible to users so the users can grip the hand grips and hold on to the device during rocking.

The device can be elongate with elongate opposite sides extending along the arc-shaped bottom surface so that users mount the device which extends between the users' legs. In such instance, the device includes smaller stabilizing side bodies which are secured to the main body along the elongate opposite sides of the main body adjacent the generally arc-shaped bottom surface to stabilize the device and keep it from rolling over and also to provide foot rests for users straddling the main inflatable body. The user's feet do not generally touch or rest on the ground during play. Hand grips are positioned along the main body to be held by the user and can be positioned to be held in front of or behind the user. The device can be used, and is relatively stable, in water or on a supporting surface such as the ground or a floor. The device can be rocked back and forth similarly to a rocking horse, but without the inherent risks of a rocking horse.

Several of the devices may be joined in side-by-side relationship so that users can sit side-by-side. In such cases, a single stabilizing body can be positioned between each side-by-side main body to provide the foot rest. In some instances, a plurality of main bodies may be joined in side-by-side relationship without any stabilizing bodies since the additional main bodies will serve as the stabilizing bodies.

The inflatable main body of the device can also be generally circular giving the device the shape of a bowl. Users will then generally mount the device and take a position in the bowl. Hand grips are provided for a user within the bowl to hold body position in the bowl and outside the bowl in order to pull or tip the edge of the bowl down to achieve entrance to the bowl. If desired, a foot rest can be provided for user's feet in the center of the bowl or concentrically around the inside of the bowl spaced outwardly from the center depending upon the size of the bowl. The bowl is then tipped or rocked back and forth by the users in the bowl.

A pole or other handle securing means may be secured to the main body with ropes with hand grips, other handles, or similar holding means extending therefrom. A user can stand on the device and hold on to the rope or handle for support.

The top surfaces of the devices may be arcuate or may be substantially flat.

THE DRAWINGS

Figure 2:
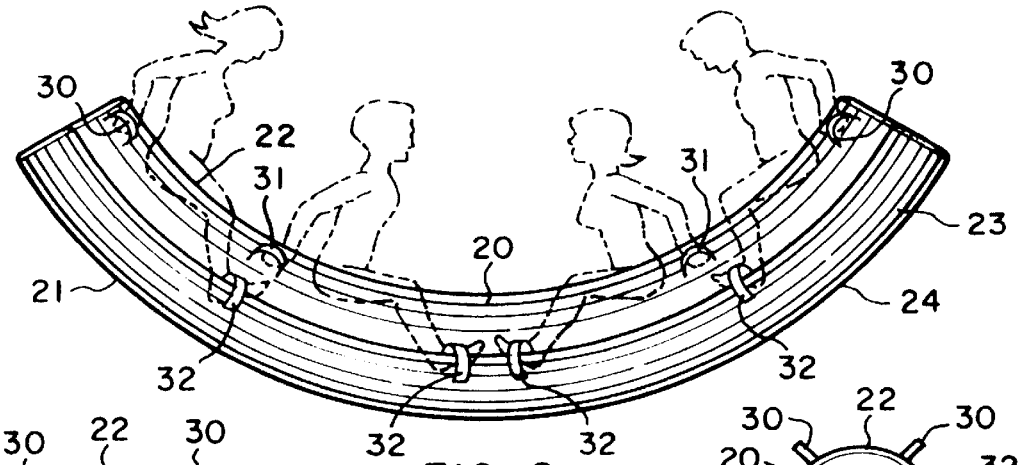
Figure 4:
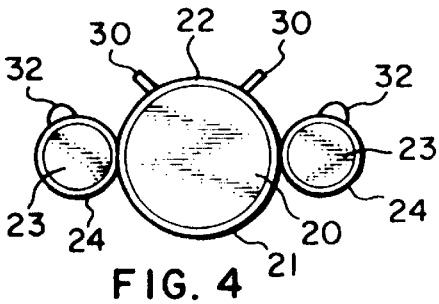
Figure 3:
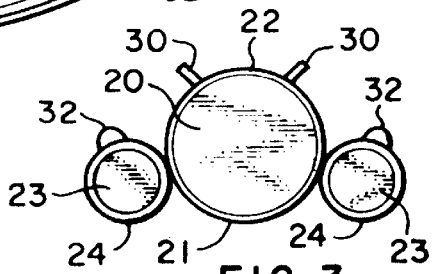
Figure 5:
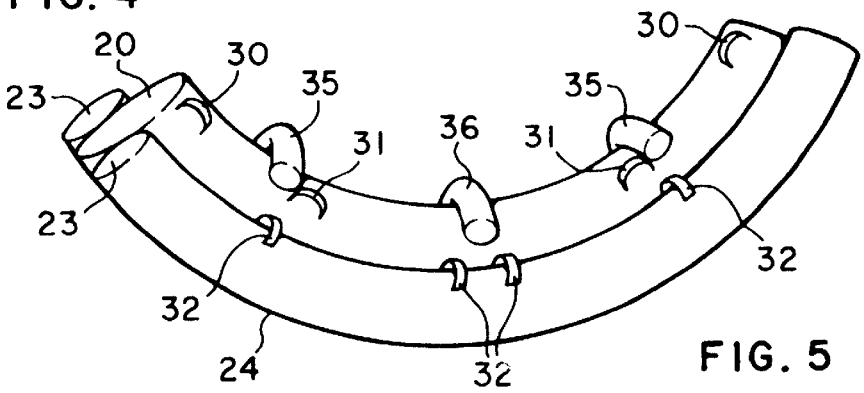
Figure 6:
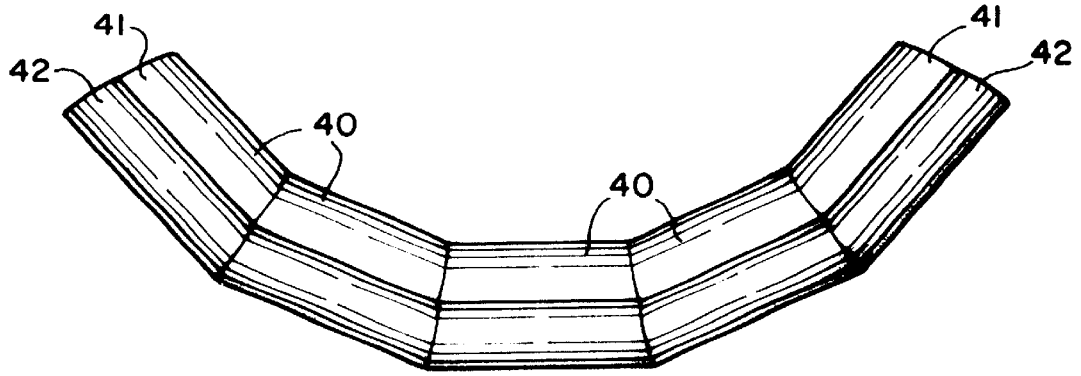
Figure 7:
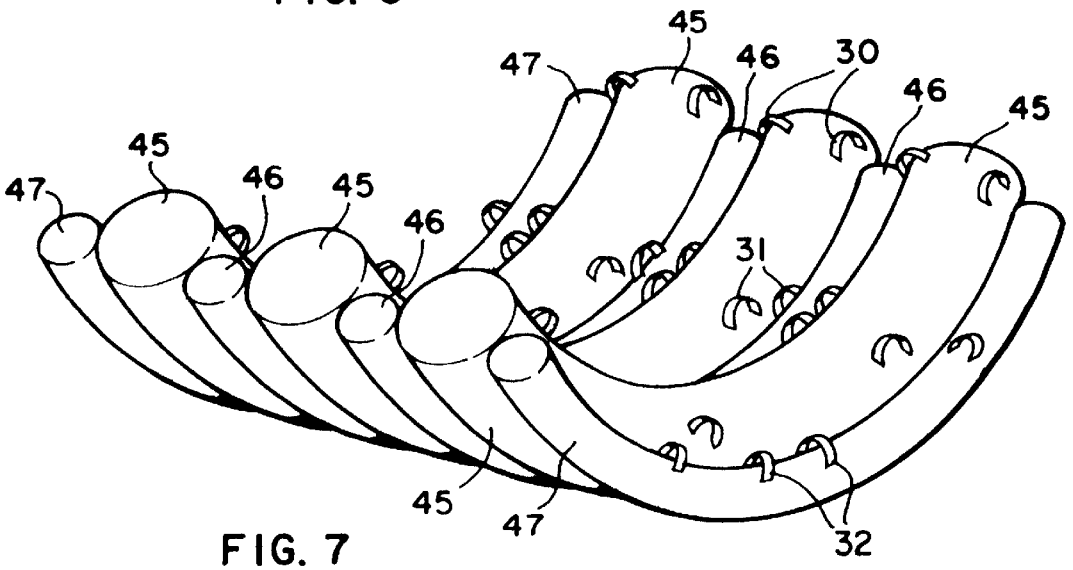
Figure 8:
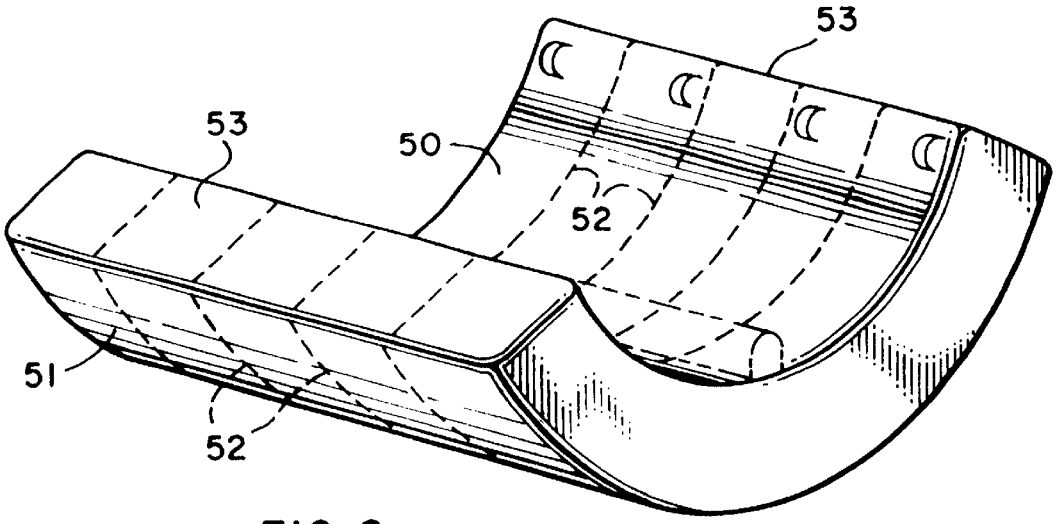
Figure 9:
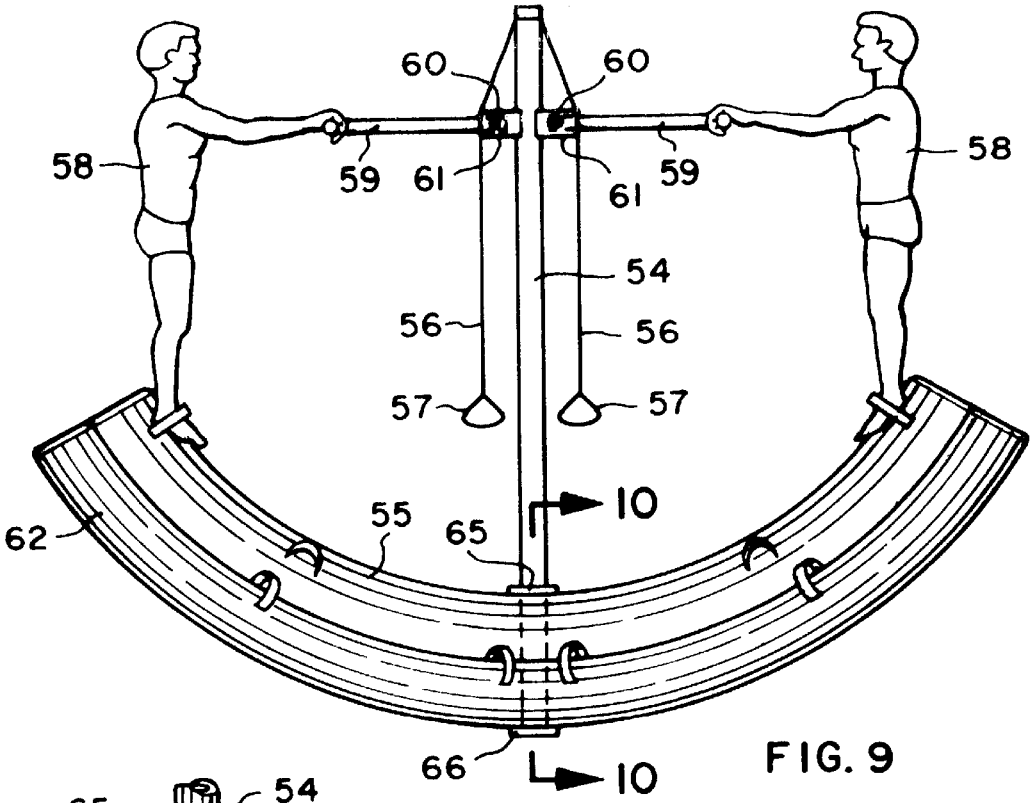
Figure 10:
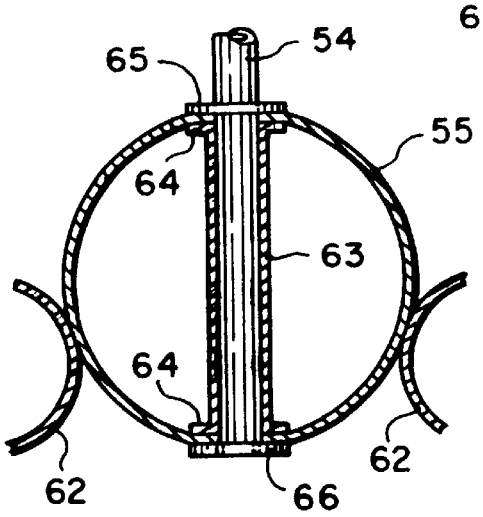
Figure 11:
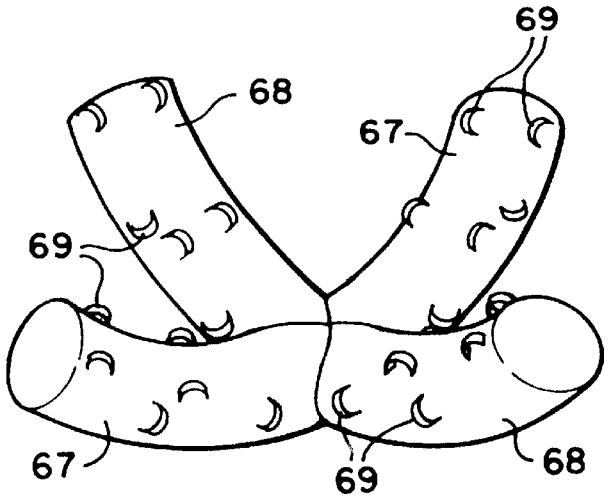
Figure 13:
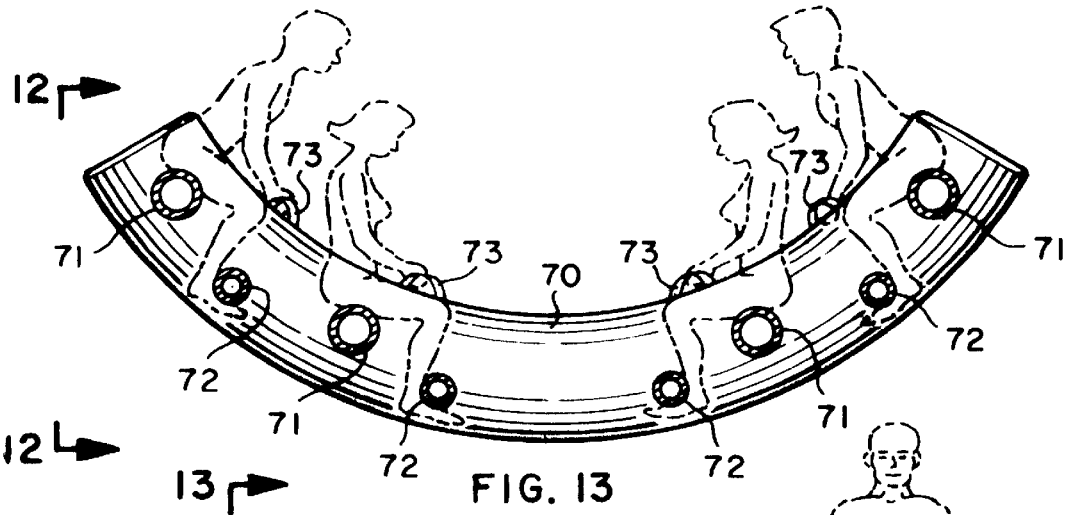
Figure 12:
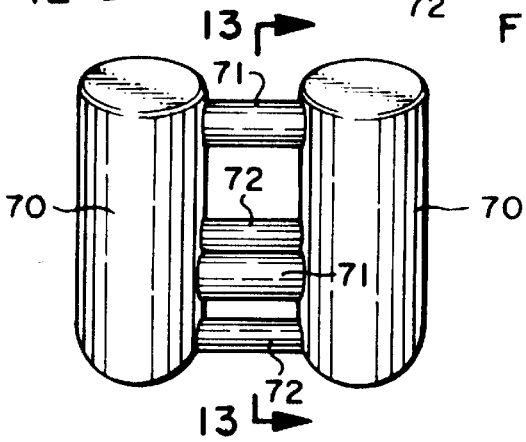
Figure 14:
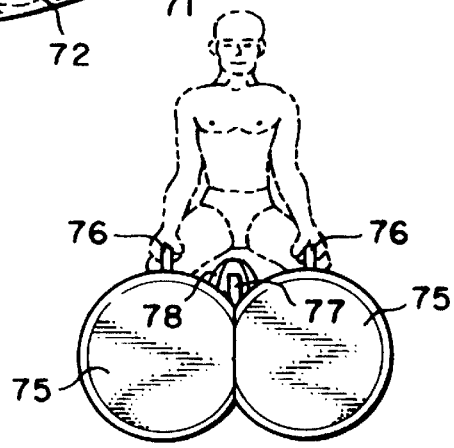
Figure 15:
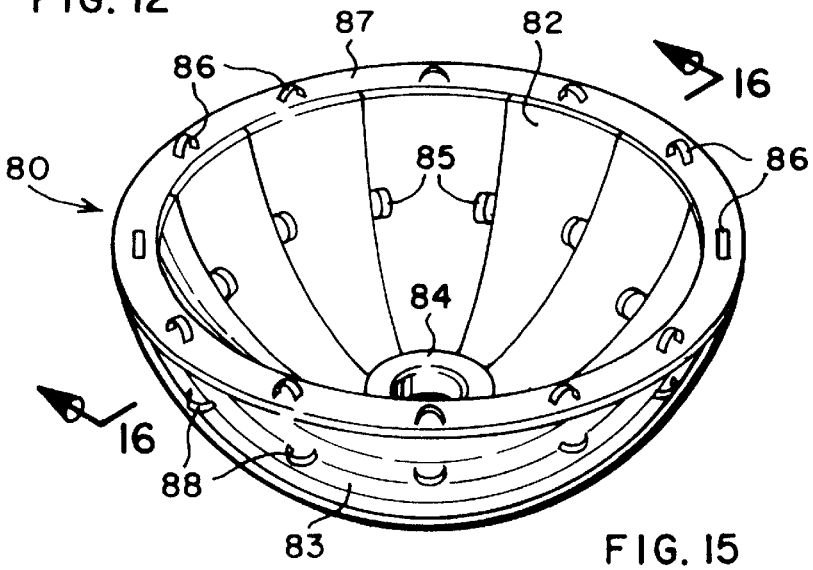
Figure 16:
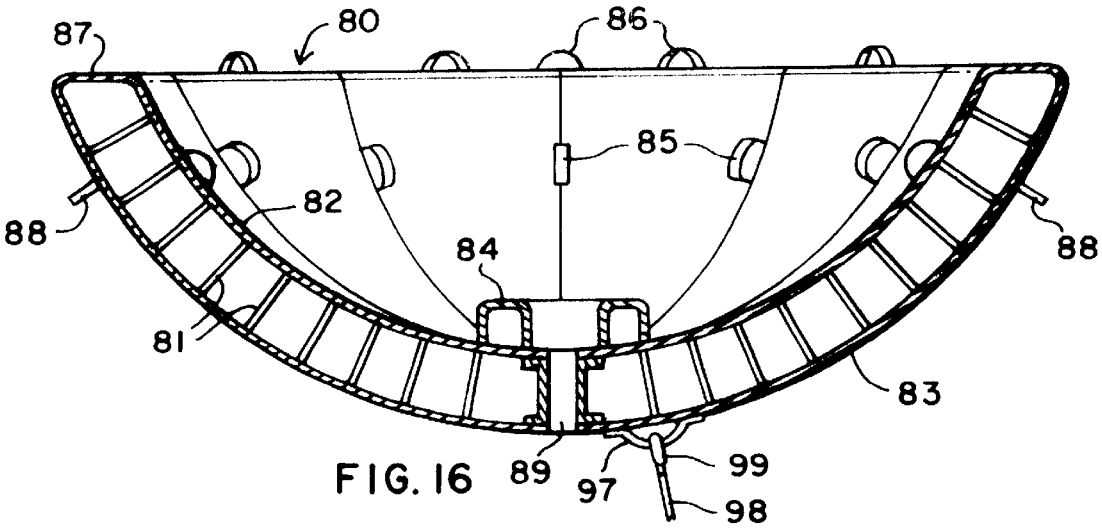
Figure 17:
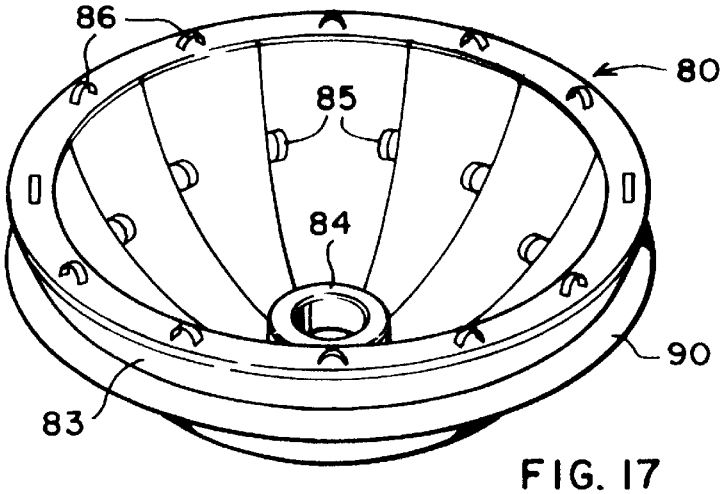
Figure 18:
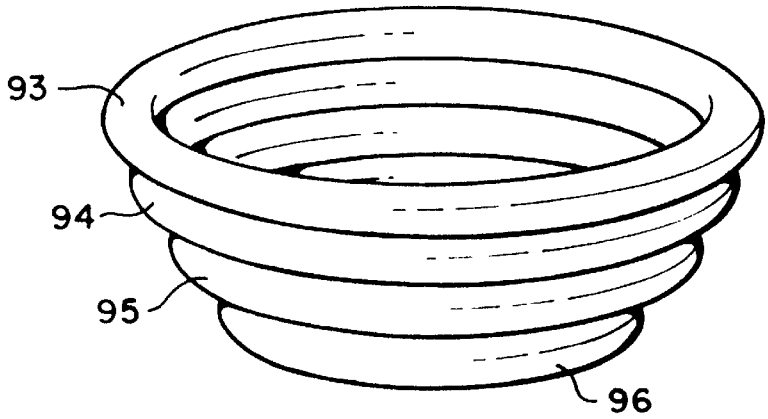
Figure 19:
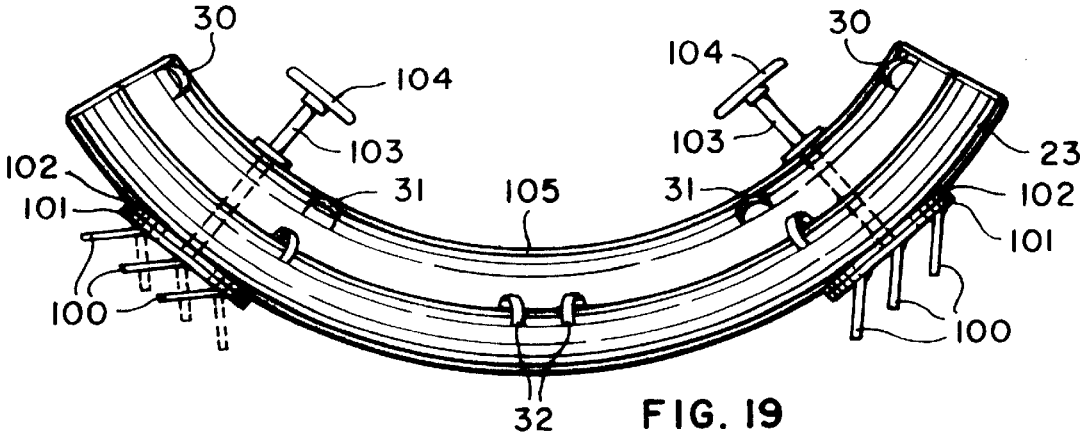

The best mode presently contemplated for carrying out the invention is illustrated in the accompanying drawings, in which:

FIG. 1 is a pictorial view of one embodiment of a device of the invention;

FIG. 2, a side elevation of the device of FIG. 1;

FIG. 3, an end view of the device of FIG. 1;

FIG. 4, an end view similar to that of FIG. 3, but showing a different arrangement of the main and stabilizing bodies;

FIG. 5, a view similar to that of FIG. 1, showing additional components;

FIG. 6, a side elevation similar to that of FIG. 2, but showing a different embodiment of the device;

FIG. 7, a pictorial view of a further embodiment of the invention;

FIG. 8, a pictorial view of a further embodiment of the invention;

FIG. 9, a pictorial view similar to that of FIG. 1 showing a further embodiment of the invention;

FIG. 10, a fragmentary vertical section taken on the line 10—10 of FIG. 9;

FIG. 11, a pictorial view of a further embodiment of a device of the invention;

FIG. 12, an end elevation of a further embodiment of a device of the invention;

FIG. 13, a vertical section taken on the line 13—13 of FIG. 12;

FIG. 14, an end elevation of a further embodiment of a device of the invention;

FIG. 15, a pictorial view of a further embodiment of the invention;

FIG. 16, a vertical section taken on the lines 11—11 of FIG. 10;

FIG. 17, a pictorial view of the embodiment of FIGS. 15 and 16 showing an additional stabilizing ring;

FIG. 18, a pictorial view of a device similar to that of FIGS. 15 and 16, but showing a different construction;

FIG. 19, a side elevation similar to that of FIG. 2, but showing a further embodiment of the invention.

Figure 20:
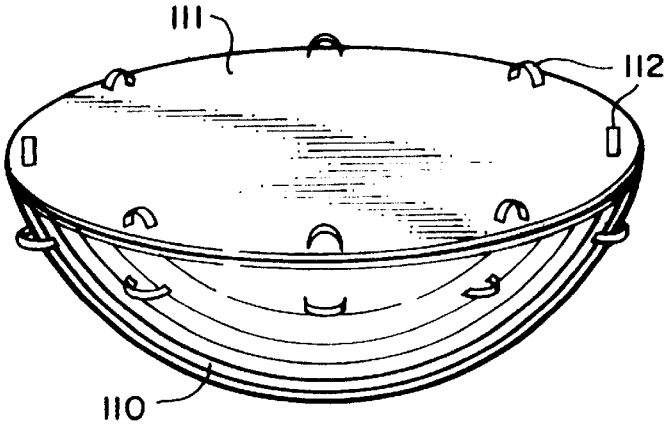
Figure 21:
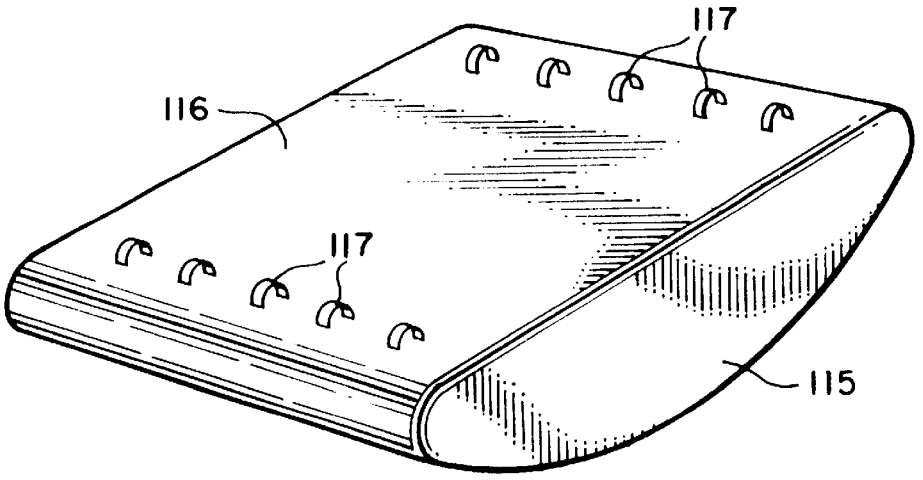

FIG. 20, a pictorial view of an embodiment of the invention having a straight top; and FIG. 21, a pictorial view of a further embodiment of the invention having a straight top.

DETAILED DESCRIPTION OF THE ILLUSTRATED EMBODIMENTS

The inflatable recreational device of the invention may take many forms. As shown in FIGS. 1–3, an inflatable main body 20 takes an arcuate tube shape form with arcuate bottom surface 21. Top surface 22 is also shown as arcuate. Smaller inflatable stabilizing bodies 23 are positioned along the opposite elongate sides of main body 20 adjacent the arcuate bottom surface 21 and have their own arcuate bottom surfaces 24 which are similar to the bottom arcuate surface 21 of main body 20. The arcuate bottom surfaces 21 of main body 20 and 24 of stabilizing bodies 23 may be substantially aligned as shown in FIGS. 1–3. This creates a stable device because of the wide bottom surface of the device which extends from one bottom side surface 24 to the opposite side bottom surface 24, FIG. 3. Substantially the same stability would be achieved if the stabilizing bodies 23 were positioned with their bottom surfaces 24 below the bottom surface 21 of main body 20. In some instances, it may be desirable to allow some side-to-side tipping of the device. If such is the case, stabilizing side bodies 23 may be secured to main body 20 so that the bottom arcuate surface 24 of stabilizing bodies 23 are above the bottom arcuate surface 21 of main body 20 as shown in FIG. 4. This will generally allow some side-to-side rocking of the device, the extent of such rocking being dependent upon the relative height of the bottom surfaces. The higher the stabilizing bottom surfaces 24 are in relation to the bottom surface 21 of main body 20, the more side-to-side tipping will occur.

The device is generally sized to accommodate more than one user with sizes for two (one user at each end), four (two users toward each end), or six (three users toward each end) having been found to work well. The users sit straddling the main body with their feet on the top surface of the opposite side stabilizing bodies. Hand grips 30 and 31 are provided along the upper portion of the main body so that users can hold onto the main body. The grips can be positioned as desired along the body. It has been found that users seem to prefer hand grips located so that the user holds the hand grips at a location behind the user's body rather than in front of the user's body. Thus, two users could be seated at opposite ends of the device in front of hand grips 30 so that hand grips 30 can be held behind the body. Two additional users could be seated in front of hand grips 31 so could hold hand grips 31 behind the body. Foot stirrups 32 can be provided along the upper surface of stabilizing side bodies 23 for the user's feet, if desired.

If desired, separators 35, FIG. 5, may be provided along the upper surface of main body 20 to separate and mark the places for users to sit. These hold users from flying forward when their end is up. This is particularly important if a person is small so their feet do not reach the top of the stabilizing bodies. The separators can also serve as backrests for the user and additional separators can be provided at opposite ends of the device to provide back rests for the user at the opposite ends, if desired. A center separator 36 may also be provided to separate the two facing inside users.

The generally arcuate bottom surfaces may take the form of a relatively smooth arc as shown in FIGS. 1, 2, and 5, or may be segmented and formed from a plurality of joined substantially straight sections as shown in FIG. 6. Lengths of substantially straight sections 40 for both the main body 41 and the side stabilizing bodies 42 are joined together end-to-end at angles to one-another to form a generally arcuate bottom surface. It has been found that the sectional device works comparably to the smoothly arced devices.

The devices of the invention can be made in various sizes. It has been found that the devices of FIGS. 1–6, when used for up to four children, work well if about ninety inches long with a vertical rise from the center to the ends of about three feet. The diameter of the main body may be about eighteen inches and the diameter of the stabilizing bodies may be about nine inches. For holding up to four adults, the length of the device should be about eleven feet with a vertical rise from the center to the ends of about four feet. The diameter of the main body may be increased to about two feet with the diameter of the stabilizing bodies being about one foot. These dimensions are given as examples of what has been found satisfactory, but the various dimensions can vary substantially.

Devices of different configuration and which can accommodate more people may be made by making a wider version of the device that will accommodate several people at each location along the device in side-by-side configuration.

The version of the device shown in FIG. 7 is similar to several of the devices of FIGS. 1–3 secured together in side-by-side fashion, except that only a single stabilizing body is placed between adjacent main bodies. Thus, three main bodies 45 are secured together with smaller stabilizing bodies 46 sandwiched therebetween and with outer opposite side stabilizing bodies 47 forming the edges. The intermediate stabilizing bodies 46 sandwiched between the main bodies are not needed for stabilization but provide space between each main body so users can sit astride any of the main bodies and have places for their feet. Hand grips, foot grips, separators, etc. can be provided as desired and as indicated for the prior embodiments.

Rather than having a wide device for the users to sit on as shown in FIG. 7, a generally smooth surfaced wide device may be provided as shown in FIG. 8. The device of FIG. 8 has a substantially smooth, concave top surface 50 and substantially smooth, convex bottom arcuate surface 51. Seams 52 merely indicate where baffles may be placed and secured inside the device to form the substantially smooth top and bottom surfaces. A substantially smooth surface contemplates some undulations or irregularities in the surface. Users mount the device and lie thereon with their feet toward the middle of the device and their heads toward the opposite ends 53 of the device. Hand grips can be provided as desired and a cushion or divider can be provided across the middle of the device between the ends 53 thereof to act as a foot support and separate users on opposite ends of the device.

Devices such as those shown in FIGS. 7 and 8, as with the other configuration, may be of various sizes. Lengths of about six, nine, and twelve feet with widths of about four and six feet and with a height from the center to the ends of about four feet are satisfactory.

FIG. 9 shows a device similar to that of FIG. 1, but with a vertical pole or mast 54 extending from main body 55. Ropes or cables 56 with hand grips 57 at their ends are attached to the top of pole 54 and can be held by standing users 58, as shown, to provide support when standing, or rigid handles 59 can be pivotally attached to pole 54 such as by bolts 60 passing through handles 59 and brackets 61. While the users will generally stand on main body 55, as shown, they could stand with their feet on opposite side stabilizing bodies 62. Such ropes or handles could also be used by sitting users.

To hold pole 54, and secure it to the main body 55 a tubular hole formed by tube 63, FIG. 10, sealed at its ends by gluing tube flanges 64 to the inside of main body 55, is formed in main body 55. The tubular hole inside diameter is preferably just slightly larger than the outside diameter of pole 54 so pole 54 can be inserted therethrough. Pole 54 includes a flange 65 secured thereto spaced from the bottom end of pole 54 the approximate thickness of main body 55. Pole 54 can be threaded at its bottom end so that a flange 66 can be removably secured thereto, or other means can be provided for removably securing flange 66 to the bottom end of pole 54. Main body 55 is tightly sandwiched between flanges 65 and 66 and the flanges will cause a slight flattening of the main body as shown. In inserting pole 54 through the hole in the body, it may be necessary to deflate the body somewhat since the inflation of main body 55 will cause the walls 63 of the hole to bulge inwardly reducing the inside diameter of the hole. This helps to securely hold the pole in place during use.

FIG. 11 shows an arrangement where essentially two main bodies 67 and 68 are joined in their centers and extend at angles to one another. No stabilizing bodies are needed since the angled main bodies will help to prevent the device from rolling sideways. However, stabilizing bodies may be added for foot support, if desired. Handles 69 can be provided as desired. The main bodies can be joined at a variety of angles such as ninety degrees, sixty degrees, forty-five degrees, etc.

FIGS. 12 and 13 show an embodiment of a device of the invention with two spaced side-by-side main bodies 70 connected with smaller seat tubes 71 and foot holding tubes 72 extending transversely between them. Users sit on the seat tubes 71 and put their feet under the foot holding tubes 72 to position themselves in the device. They can then hold on to hand grip 73 secured to the tops of main bodies 70.

FIG. 14 shows an embodiment of the device with two main bodies 75 joined together in side-by-side relationship. A user can kneel with one knee on each body and hold on to handles 76 provided on top of each body. With the embodiments of FIGS. 12–14, stability for the device is provided by the side-by-side main bodies. The smaller stabilizing bodies are not necessary. Handles 77 can be provided between bodies 75, if desired, so a user can hold on centrally of his or her body. Further, a ring 78 can be provided in the center of the device to which ropes or handles can be attached to extend toward the ends of the device similarly to the ropes or handles of FIG. 9 to be held by users standing, kneeling, or sitting at the ends of the device.

FIGS. 15 and 16 show a bowl-like arrangement of the device. The inflatable body 80 is generally circular and in the form of a bowl with connecting tubes 81 or baffles secured along the inside in known manner to provide substantially smooth concave top surface 82 and convex bottom surface 83. If elongate baffles are used, they will generally extend radially and in effect section the bowl as shown by broken lines 80*a*. The bowl is dimensioned so that several users can get into the bowl with feet at the bottom of the bowl and heads toward the top edge of the bowl. A foot rest 84 can be provided at the center of the bowl, and handles 85 can be provided for a user to hold when in the bowl. Handles 86 on the top edge 87 of the bowl and handles 88 on the bottom surface 83 of the bowl are provided so a user can pull or tip the edge of the bowl down to achieve entrance to the bowl. A tubular hole 89 can be provided in the center of the bowl, if desired, for mounting a pole therein similar to that shown in FIG. 9.

The bowl may be provided in several sizes with a bowl having an overall diameter of about twelve feet, which with a side thickness of about one foot, gives an inside bowl diameter of ten feet, being satisfactory. Such a bowl may have a side height of about five feet. The central foot rest 84 can be about eight inches high and about two feet in diameter.

If desired to limit the potential tipping or rocking action of the bowl, a stabilizing body 90, FIG. 17, similar to a large inner tube, may be secured around the bottom surface 83 of bowl 80. The positioning or height of stabilizing body 90 from the bottom to the top of the bowl will determine the extent of rocking or tipping allowed by bowl 80 with more tipping or rocking taking place the higher the ring is on the bowl. This stabilizing body may be permanently mounted to the bowl or removably mounted. When permanently mounted, it may be separately inflatable so it can be inflated when desired or deflated if not desired. A limit to the extent of tipping may be desired for small children or older adults.

The bowl configuration can also be formed of a number of circular tubular bodies secured together or spiraled together. Thus, as shown in FIG. 18, the bowl-shaped device may be made up of circular inflatable bodies 93, 94, and 95, and bottom 96. Bottom 96 is an inflatable disc to form a relatively flat bottom with successively larger circular bodies 95, 94, and 93 secured thereto to form the bowl.

The device of the invention may be used in the water, such as in a swimming pool or in a lake, or may be used on a surface such as the ground or a floor. Particularly when used in water, it will generally be desirable to anchor or tether the device so, for example, in a swimming pool, the device will not drift to the side of the pool during use, such as vigorous rocking activity, where a person rocking on the device or falling off of the device can hit the wall and become injured. The same considerations are present in larger bodies of water such as lakes where it is usually desirable to keep the device from the shore, and also, in large bodies of water, to keep the device generally in the same area. For such purpose, the device of the invention can be provided with anchoring rings for the connection of a tether. For example, with the bowl device of FIGS. 15–17, an anchoring ring 97, FIG. 16, may be secured to the bottom of the device. An anchoring or tethering line 98 is connected to ring 97 in any suitable manner such as with a clip 99. When in a body of water such as a swimming pool, the other end of the tethering line 97 may be connected to a ring or hook in the bottom of the pool, to a heavy anchoring object resting on the bottom of the pool, to a suction cup secured to the bottom of the pool, or similar tethering site. Side tethers can also be used. In a lake, the other end of tethering or anchoring line 98 can be connected to a ring or hook in the bottom of the lake or to an anchor device such as a boat anchor. Tethering line 98 may be rope, cable, or, if desired, an elastic line such as a bungee cord to allow some movement of the device in the water.

With devices such as shown in FIGS. 1–14, similar anchoring or tether lines will generally be used and tethering rings will be attached to the bottom and/or sides of the device.

Various types of handles can be used on the devices of the invention. The handles can provide handle loops as shown glued to the device or may be in various different configurations such as substantially rigid handles and bases as commercially available for gluing onto the devices.

FIG. 19 shows an embodiment of device similar to that of FIGS. 1–3, but with the addition of a propelling means positioned on the bottom surface of the device. Such embodiment will apply principally to devices for use in water. The propelling means shown is a plate 100 having angled vanes or fins 101 extending therefrom. Because of the angle, when moved through the water by reason of the rocking action of the device, the fins have a thrust direction. The plate is rotatably mounted in an end portion of the device against a stationary bearing plate 102 so that it can be rotated by a user to change direction of the vanes and thus the thrust direction of the vanes. A shaft 103 with top handle 104 is secured at its bottom end to plate 100, and extends through a hole in main body 105 and is secured to body 105 in a manner similar to pole 54 as shown in FIGS. 9 and 10. Such a plate can be mounted in opposite end portions of the device, as shown, although a single propelling device could be mounted in the center of the device. The users can align the vanes in a desired direction which would cause the device to move in the opposite direction to the thrust direction as the vanes move downwardly in the water. By rocking the device back and forth and appropriately arranging the vanes, the device can move in the water.

While the various embodiments of the device illustrated show an arced bottom surface, the generally arced bottom surface is all that is needed for the device to rock. The top surface could take various forms and could be a flat surface extending from side-to-side of the device. Thus, a bowl device 110, FIG. 20, similar to the bowl device of FIGS. 15–17 could have a flat top surface 111 with handgrips 112 as desired. Similarly, a device 115, FIG. 21, similar to the device of FIG. 8, could also have a flat top surface 116 with handles 117 as desired.

The various inflatable bodies shown forming a single device could be joined in air communication with one another so all are inflated together, or they could be each sealed bodies separately inflated.

Whereas this invention is here illustrated and described with reference to embodiments thereof presently contemplated as the best node of carrying out such invention in actual practice, it is to be understood that various changes may be made in adapting the invention to different embodiments without departing from the broader inventive concepts disclosed herein and comprehended by the claims that follow.

What is claimed is:

1. An inflatable rocking recreational device, comprising:

an inflatable body having a generally arc-shaped bottom surface, a top surface, and end portions; and hand grips secured to the body and positioned to be accessible to a user mounted on the body;

wherein the device is sized to accommodate at least two users on each end portion, and additionally including separators on the top surface of each end portion to separate the users.

2. An inflatable rocking recreational device according to claim 1, additionally including a center separator dividing the end portions.

3. An inflatable rocking recreational device according to claim 1, wherein the inflatable body has a top surface and the top surface is arcuate.

4. An inflatable rocking recreational device, comprising:

an elongate inflatable body having a generally arc-shaped bottom surface with elongate sides;

stabilizing bodies adjacent the elongate sides of the inflatable body positioned and sized to stabilize the orientation of the inflatable body and provide a resting place for feet of users mounted on the inflatable body; and hand grips secured to the body and positioned to be accessible to a user mounted on the body.

5. An inflatable rocking recreational device according to claim 4, additionally including a central hole extending approximately through the center of the inflatable body.

6. An inflatable rocking recreational device according to claim 5, additionally including a pole mounted in the central hole and extending upwardly therefrom, and handle means extending from the pole.

7. An inflatable rocking recreational device according to claim 6, wherein the handle means are flexible lines attached to the pole with hand grips on the lines.

8. An inflatable rocking recreational device according to claim 6, wherein the handle means are pivotally mounted to the pole and extend outwardly from the pole when in use.

9. An inflatable rocking recreational device according to claim 4, additionally including central means for securing handle means thereto.

10. An inflatable rocking recreational device according to claim 9, additionally including handle means attached to and extending from the means for securing handle means thereto.

11. An inflatable rocking recreational device according to claim 10, wherein the handle means are flexible lines attached to the means for securing handle means thereto with hand grips on the lines.

12. An inflatable rocking recreational device according to claim 4, additionally including means for attaching at least one tethering line.

13. An inflatable rocking recreational device according to claim 4, additionally including propelling means.

14. An inflatable rocking recreational device according to claim 13, wherein the propelling means include fins mounted in end portions of the inflatable body with such fins having a thrust direction when moved in the water as a result of rocking motion of the inflatable body and such fins are adjustable by a user to control the direction of thrust.

15. An inflatable rocking recreational device according to claim 4, wherein the stabilizing bodies are inflatable and have generally arc-shaped bottom surfaces similar to the generally arc-shaped bottom surface of the inflatable body.

16. An inflatable rocking recreational device according to claim 15, including foot holds on the stabilizing bodies.

17. An inflatable rocking recreational device according to claim 4, wherein the inflatable body has a top surface and the top surface is arcuate.

18. An inflatable rocking recreational device, comprising:

an inflatable body having a generally arc-shaped bottom surface and elongate sides; and stabilizing bodies adjacent the elongate sides of the inflatable body positioned and sized to stabilize the orientation of the inflatable body and provide a resting place for feet of users mounted on the inflatable body.

19. An inflatable rocking recreational device according to claim 18, wherein the inflatable body has a top surface and the top surface is arcuate.

20. An inflatable rocking recreational device according to claim 18, wherein the stabilizing bodies are inflatable and have generally arc-shaped bottom surfaces similar to the generally arc-shaped bottom surface of the inflatable body.

21. An inflatable rocking recreational device according to claim 18, including foot holds on the stabilizing bodies.

* * * * *